United States Patent [19]

Druschitz et al.

[11] Patent Number: 5,037,070

[45] Date of Patent: Aug. 6, 1991

[54] MELT CONTAINMENT APPARATUS WITH PROTECTIVE OXIDE MELT CONTACT SURFACE

[75] Inventors: Alan P. Druschitz, Rochester Hills; Susan R. Schuon, Perry, both of Mich.

[73] Assignee: General Motors Corporation, Detroit, Mich.

[21] Appl. No.: 585,347

[22] Filed: Sep. 20, 1990

[51] Int. Cl.[5] ..... C21B 3/00

[52] U.S. Cl. ..... 266/275; 266/280

[58] Field of Search ..... 266/275, 280; 420/445; 164/138, 418; 249/135

[56] References Cited

U.S. PATENT DOCUMENTS 4,546,052 10/1985 Nicoll ..... 428/680

FOREIGN PATENT DOCUMENTS 210957 12/1982 Japan ..... 249/135

617819 2/1949 United Kingdom ..... 420/445

OTHER PUBLICATIONS

"The Thermal Fatigue of Die-Casting Dies" by S. J. Noesen, et al., Transactions of the American Foundrymen's Society, vol. 75 (1967) pp. 133-146.

"Refractory Metals: New Keys to Austomated Casting of Ferrous Metals" by R. L. Barto, et al., Transactions of the American Foundrymen's Society, vol. 74, (1966), pp. 321-324.

"The Pressure Die Casting of Irons and Steels" by R. L. Barto, et al., Transactions of the American Foundrymen's Society, vol. 75 (1967), pp. 181-185.

"Die Casting of Stainless and Alloy Steels" by D. T. Hurd et al, Transactions of the American Foundrymen's Society, vol. 76 (1968), pp. 511-514.

"The Effect of Sulfur and Zirconium Co-Doping on the Oxidation of NiCrAl" (NASA Technical Memorandum 100209) by J. L. Smialek as prepared for the 172nd Meeting of the Electro-Chemical Society, Honolulu, Hawaii, Oct. 18-23, 1987, pp. 1-16.

*Primary Examiner*—Melvyn J. Andrews

*Attorney, Agent, or Firm*—George A. Grove

[57] ABSTRACT

A melt containment apparatus for containing molten metals, such as iron and aluminum, is formed of a nickel-based intermetallic alloy composed predominantly of nickel and enough aluminum and chromium to produce predominantly an ordered L12 face-centered cubic phase. The melt containment apparatus has a wall with a melt contact surface which has been oxidized to bear a protective integral oxide coating composed predominantly of a first layer formed mainly of alumina immediately overlying the wall and a second layer overlying the first layer which is predominantly composed of a spinel material having a metal constituent taken from the group consisting of nickel, aluminum and chromium. The protective integral oxide coating includes two layers, a first layer formed mainly of alumina immediately adjacent the alloy and a second layer overlying the first layer, the first layer being between 0.5 and 3 microns thick and containing at least 95 weight percent alumina, while the second layer is at least 10 microns thick and is predominantly composed of an oxide characterized by a spinel lattice structure having a metal constituent selected from the group conisting of nickel, aluminum, and chromium.

2 Claims, No Drawings

MELT CONTAINMENT APPARATUS WITH PROTECTIVE OXIDE MELT CONTACT SURFACE

TECHNICAL FIELD

This invention relates generally to materials suitable for handling or casting molten metals and more particularly relates to nickel-aluminide metallic alloy oxides for handling or casting molten metals.

BACKGROUND

Melt containment apparatus for containing molten metals are made from various materials which are selected for their anti-corrosive properties. Molten metals such as steel, gray iron and aluminum pose the greatest corrosion problems during handling. Zinc and copper are much easier to handle, so suitable materials for handling iron and aluminum will generally be able to handle molten zinc and copper. For instance, ladles required for the holding and processing of molten aluminum are typically made of a refractory material (carbon-bonded silicon carbide or clay-graphite) or refractory-coated cast iron. However, refractory materials are relatively weak, requiring large wall thicknesses to provide adequate strength. This results in a relatively high initial cost. On the other hand, refractory-coated cast iron crucibles are stronger and cheaper, but must be recoated frequently because the underlying cast iron is usually attacked by the molten aluminum being held. Coated steel ladles are generally not used because steel is even more rapidly attacked by molten aluminum than cast iron.

In addition, when casting molten iron or other ferrous materials in permanent molds, a number of problems result due to the higher molten metal temperatures required to obtain satisfactory components (approximately 650° C. is needed for aluminum while at least 1300° C. is required for iron and up to 1700° C. for steel). The molds used to cast the molten iron and other ferrous materials experience poor die life due to thermal fatigue cracking and molten metal attack. Furthermore, the difficulties of maintaining high die temperatures to avoid premature freezing of the molten iron in the mold have limited the commercial development of ferrous permanent mold casting and have also discouraged attempts at commercializing die casting of iron and steel. Typically, methods other than mold casting are used to form cast iron parts, such as sand casting.

The most widely used material for permanent molds for handling such ferrous material castings has been gray iron. Gray iron or alloy gray iron may be used as a mold material for both low and high volume production of zinc, aluminum and copper castings. In the past, poor service life of gray iron molds has been due to dimensional instability and has consequently restricted permanent mold casting of gray iron parts to low volume production. For die casting of zinc, aluminum and copper, chromium-tungsten hot work die steels and tungsten hot work die steels are typically used as mold materials. Currently, iron and steel are generally not die cast.

The primary limitations of gray iron, alloy gray iron, and the hot work die steel molds used for casting iron and steel have been molten metal attack, property degradation and dimensional instability. These limitations arise from the fact that when the mold is kept at a sufficiently high temperature to prevent premature freezing, they also cause iron carbide dissolution, scaling (oxidation), alpha-iron to gamma-iron transformation, and ®v ®n melting. Scaling produces changes in the interior mold dimensions because the scale must be removed by abrasive cleaning. Iron carbide dissolution or alpha-to-gamma transformation results in changes in both mold dimensions and mechanical properties.

Gray iron may be cast in gray iron permanent molds if the mold equilibrium temperature is kept below the alpha-to-gamma transformation temperature because the hot cast metal and molds are cooled gradually. However, in die casting, molten metal is injected into the mold and the metal and mold are cooled as quickly as possible. Due to the quick cooling, gray iron or steel cannot be die cast into gray iron or steel molds because the cooling required to maintain a mold equilibrium temperature below the alpha-to-gamma transformation temperature produces sufficiently large thermal gradients to cause cracking. Numerous attempts at developing mold materials (primarily refractory metal alloys such as molybdenum alloys) for die casting iron and steel have been unsuccessful in demonstrating sufficiently long die life to be economically feasible.

Coatings such as soot and refractory oxides are often employed in the mold to prevent the atmosphere and molten metal from contacting the die material. Although these coatings may inhibit chemical attack, they are disadvantageous because they also significantly alter heat transfer. Furthermore, these coatings are not permanent and must be replaced frequently, thus increasing down time and cost. Mold materials which do not rely on sacrificial coatings for protection are also desirable because some processes, such as vacuum and pressure casting, produce high velocity molten metal which can cause significant erosion. 5 Therefore, it is understood that there is a need in the foundry industry for an improved material which can be used to contain molten metals, such as aluminum and iron. The various melt containment apparatuses include ladles, furnaces, molds and any other article which contains molten metal for processing. Considering this need, it is a primary object of the present invention to provide a material in accordance with the present invention which is suitable for making containment vessels for molten metals, especially a material for containing molten aluminum and iron which does not dissolve or spall to contaminate the molten metal.

It is another object of the present invention to provide a material which: (1) is resistant to attack from molten metal, property degradation and dimensional instability, (2) has high temperature strength, (3) is highly fabricable (since machining costs often greatly exceed material costs), and (4) is economical and long-lasting to eliminate the down time needed to replace sacrificial mold coatings. Further, it is yet another object of the present invention to provide a material which will make die casting of molten iron commercially viable.

SUMMARY OF THE INVENTION

In accordance with the preferred embodiment of the invention, these and other objects and advantages are addressed as follows. A melt containment apparatus or foundry receptacle having a protective oxide coating is proposed for receiving molten metals, such as iron or aluminum. The melt containment apparatus may be made of a nickel-based intermetallic alloy including aluminum and chromium present in sufficient amounts to produce a predominantly L12 face centered cubic phase. Surfaces of this nickel-based intermetallic alloy which will contact the molten metal are oxidized to form a protective integral oxide coating for rendering the melt containment apparatus substantially immune to attack by the molten metal contained therein. Consequently, melt containment apparatuses are contemplated which are entirely formed from the disclosed material and coated with the protective oxide coating, as well as apparatuses formed from a base metal which are coated with the disclosed oxide material. In either case, the melt contact surface is oxidized as described herein to provide the protective oxide coating. As used herein, melt containment apparatus shall mean any foundry apparatus or portion thereof intended for contact with molten metal, which may include (1) ladles for transferring a charge of molten metal; (2) molds or dies for receiving and shaping a charge of molten metal for solidification into a product casting; and (3) conduits through which molten metal is flowed.

The foundry melt containment apparatus of this invention includes a protectively-coated metal wall for containing molten metal which is formed of a predominantly nickel alloy containing aluminum and chromium. The wall includes a melt-contact surface covered by a protective integral oxide coating having a first layer formed mainly of alumina immediately overlying the wall and a second layer overlying the first layer which is predominantly composed of a spinel material having a metal constituent taken from the group consisting of nickel, aluminum and chromium.

Another embodiment of this invention includes a foundry melt containment apparatus comprising a protectively-coated metal wall for containing molten aluminum-base or iron-base metal, the wall being formed of a nickel-based alloy having between about 8 and 10 weight percent aluminum and between about 1.5 and 8 weight percent chromium. The wall bears a melt-contact surface which includes a protective integral oxide coating having a first layer formed mainly of alumina immediately adjacent the alloy and a second layer overlying the first layer. The first layer may be between 0.5 and 3 microns thick and may contain at least 95 weight percent alumina. The second layer may be at least 10 microns thick and be predominantly composed of an oxide characterized by a spinel lattice structure having a metal constituent selected from the group consisting of nickel, aluminum and chromium.

DETAILED DESCRIPTION OF THE INVENTION

The melt containment apparatuses of this invention are formed of a nickel-based intermetallic alloy base material composed predominantly of nickel which further contains aluminum and chromium in amounts effective to produce a predominantly L12 ordered face-centered cubic phase which has been oxidized on the melt surface. The nickel-based alloy base material contains between about 8 and 10 weight percent aluminum and between about 1.5 and 8 weight percent chromium. The resultant oxide coating formed on the melt surface of the melt containment apparatus is an integral oxide coating composed predominantly of a first inner layer immediately overlying the melt surface, a second layer overlying the first inner layer and, optionally, a third outer layer overlying the second layer. The first inner layer is typically about 1 micron thick, preferably about 0.5 to 3 microns thick, and is composed predominantly of alumina. The first inner layer has predominantly a sesquioxide lattice structure generally the form of $X_2O_3$ where X may be aluminum, iron or chromium. Aluminum is present in the first inner layer in a sufficient amount to account for at least 75 weight percent, more preferably about 95 weight percent, of the oxidized metal.

The second layer overlying the first inner layer is adapted for direct contact with the melt and must be present in a sufficient thickness so as to be effective for protecting the underlying nickel-based alloy base material from being dissolved into the melt received in the melt containment apparatus. A suitable thickness for this second layer is at least about 5 microns thick, more preferably between about 10 and 30 microns thick. The second layer is composed predominantly of oxide but may include residual metals, such as nickel. The oxides are predominantly characterized by a spinel lattice structure, $NiM_2O_4$, where M may be aluminum or chromium. The second layer may also contain alumina and/or nickel oxide. Alumina is generally present in greatest concentration adjacent the first inner layer and may be present in progressively diminishing concentrations toward the melt contact surface, whereas nickel oxide is generally present in greatest concentration adjacent the melt contact surface and present in progressively diminishing concentrations toward the first inner layer. Typically, the second layer has an aluminum content greater than the total of one-half of the nickel content plus the chromium content.

The optional third outer layer is preferably formed predominantly of nickel oxide. This layer tends to spall when in contact with melt and, therefore, does not significantly contribute to the protection of the base metal. The third layer typically contains spinel having a metal constituent selected from the group consisting of n::ckel, aluminum and chromium. The nickel content in this layer is typically greater than the total of twice the aluminum content plus twice the chromium content. When present, the outer layer may be at least 5 microns thick.

The nickel-aluminum intermetallic alloy base material used for the melt containment apparatus of this invention may be nickel aluminide IC 2I8, a nickel-aluminum-chromium intermetallic alloy developed by Oak Ridge National Laboratory, Oak Ridge, Tenn., as disclosed in U.S. Pat. No. 4,731,221 issued Mar. 15, 1988, which is hereby incorporated by reference. Nickel aluminide IC 218 (nominally 8.5 wt % Al, 7.8 wt % Cr, 0.8 wt % Zr, 0.02 wt % B, balance Ni) is currently produced in commercial quantities by Armco Incorporated of Middletown, Ohio. Although the unoxidized form of this material is quickly dissolved by either molten aluminum or molten iron, the oxidized version is relatively inert to the same molten metals.

Further in accordance with the present invention, the melt containment apparatus may be either formed totally from the nickel aluminide or of another suitable material coated with the nickel aluminide on the melt contact surface to conserve costs. The nickel aluminide alloy IC 218 has an advantage in that it can be melted and cast to near net shape. A melt containment apparatus having the nickel-aluminum intermetallic alloy on the melt surface is suitably treated by heating in an oxidizing atmosphere (e.g., air, low-oxygen atmosphere, etc.) to form a strongly adherent protective oxide layer which has significant resistance to attack from both molten aluminum alloy and molten gray iron, two of the most corrosive metals to contain. This shows a distinct advantage over the prior art because the containment apparatus is dissolved much less by the melt.

Specific suitable oxidation temperatures and times for forming the oxide on the nickel-aluminide melt surface include the following individual heat treatments in an oxygen-containing environment: (1) 850° C. for 24 hours, (2) 900° C. for 4 to 24 hours, (3) 1000° C. for 0.5 to 24 hours, or (4) 1100° C. for 0.5 hours. The oxide material thus formed on the heat-treated nickel aluminide alloy IC 218 exhibits excellent resistance to attack from molten cast iron, slag and aluminum This oxide material merely shows a color change when contacted with molten metals, without adherence of the metal or slag, rather than being dissolved by the melt. The oxide material coating formed during the heat treatment substantially prevents molten metal attack, resists strong reactions with molten slag, and resists spalling during thermal cycling. Since unprotected nickel aluminide is not resistant to molten metal attack, a uniform and continuous protective oxide layer over the base nickel aluminide alloy is a true advantage.

After exposure to molten metals, analysis of the oxidized nickel-aluminide alloys as prepared above has indicated that (1) Al is resistant to attack by molten aluminum and (2) both $Ni(Al, Cr)_2O_4$ and $Al_2O_3$ are resistant to attack by molten gray iron. The lattice structure of these metals is in the form of a spinel in the case of $Ni(Al, Cr)_2O_4$ and a sesquioxide in the case of $Al_2O_3$.

Potential applications for the oxidized nickel-aluminide alloys are any melt containment apparatuses, such as permanent and die cast molds for molding molten iron, aluminum, zinc, copper, etc., as well as transfer ladles for transferring all of the same metals, with the exception of iron due to its high melting temperature and the long duration of immersion which ladles experience. Although the melting point of the nickel aluminide is approximately 1390° C. for IC 218, the oxide of the nickel aluminide can be exposed to high temperatures for short periods of time, as evidenced by a dip and immersion test in molten gray iron at 1400° C. to 1475° C. as discussed in the examples that follow. The oxidized nickel aluminide is, therefore, highly suitable as a mold material for gray iron (which is molten at 1300°-1540° C.), since molds are only exposed to high temperatures for a few seconds during a casting cycle Thus, there is provided in accordance with the present invention an improved material for the foundry industry which can be used to contain molten metals such as aluminum and iron and which will not substantially dissolve, degrade or spall while in contact with the molten metal. The material of this invention has good high temperature strength and is fabricable and economical.

EXAMPLES

The following examples are illustrative only and should not be construed as limiting the invention which is properly delineated in the appended claims.

To prepare the nickel aluminide test bars for the following examples, nickel aluminide alloy IC 218 was air melted and cast into keel blocks. The composition of the melt was determined to be 8.4 wt % Al, 6.9 wt % Cr, 0.62 wt % Zr, 0.026 wt % B, with the balance being Ni. One keel block was cut by electro-discharge machining into square bars which were ground to 10 mm ×10 mm ×55 mm. The bars were standing on one of the 10 mm ×10 mm surfaces during oxidation. For each of the examples below, the surfaces of test bars of nickel aluminide alloy IC 218 were oxidized in air and prepared as individually indicated.

For each of the analyses described below, samples were first analyzed by X-ray diffraction on a RIGAKU diffractometer using Cu-K-alpha radiation. The samples were then sectioned, mounted and polished using standard metallographic techniques. The mounted samples were analyzed by electron probe microanalysis (Cameca Instruments, Inc., Stamford, CT, model MBX electron probe). All phases were analyzed using a 15 keV accelerating voltage. Quantitative phase analysis was performed. The accuracy of the reported microprobe data was plus or minus 5 percent relative for metallic phases and plus or minus 10 percent relative for oxide phases Oxygen was detected by a microprobe, and oxygen content was calculated by weight difference.

OXIDE COMPOSITION ANALYSIS BEFORE MOLTEN METAL CONTACT

A nickel aluminide oxide layer was formed on a nickel aluminide alloy substrate by oxidizing a test bar at 1000° C. in air for four hours. The resultant oxide was tested, and it was discovered that it consisted of: (1) an outer discontinuous layer of NiO, (2) a two-phase middle layer consisting of a first high nickel content metallic phase (96 at% Ni, 2.5 at% Cr, 1 at% Fe, 0.5 at% Al) surrounded by a second oxide phase of $Ni(Al, Cr)_2O_4$ containing 3 at% Fe, and (3) an inner continuous layer of $Al_2O_3$ contain.ing 2 at% Ni and 3 at% Cr. Also, the nickel aluminide alloy substrate had an aluminum and chromium depleted region adjacent to the oxide layer. The small amount of Fe found in most of the phases is believed to be an impurity which was present in the nickel aluminide IC 218. This specimen was not analyzed for zirconium. Analysis of the same specimen after immersion in molten gray iron revealed that zirconium was present in the oxide layer and was uniformly distributed within the $Ni(Al, Cr)_2O_4$ phase and in the substrate as discrete particles.

The following examples which include analysis of the protective oxide-molten metal reaction product layers show that $Al_2O_3$ is the phase primarily responsible for the improved resistance to attack from molten metals.

EXAMPLE 1

Resistance to Attack by Molten Aluminum

An oxidized test bar was prepared by oxidizing a test bar of nickel aluminide IC 218 at 1000° C. for four hours. Resistance to attack by molten aluminum was determined by completely immersing the oxidized nickel aluminide IC 218 specimen into molten aluminum alloy 319 maintained at 670° C. for about 30 minutes. The composition of the aluminum melt was approximately 6.3 wt % Si, 3.5 wt % Cu, <1.0 wt % Fe, <1.0 wt % Zn, <0.35 wt % Ni, <0.25 wt % Ti, <0.1 wt % Mg, balance Al.

Immersion tests demonstrated that nickel aluminide IC 218 oxidiz®d at 1000° C. for four hours had significant resistance to attack from molten aluminum. Visual tests indicated some "sticking" of aluminum to the oxidized nickel aluminide IC 218 sample occurred but this material could be removed by scraping. Dissolution of the nickel aluminide IC 218 into the melt occurred at the bottom surface of the test bar which had apparently not been oxidized properly, as evidenced by a lack of material which was dark green in appearance.

EXAMPLE 2

Resistance to Attack by Molten Aluminum

Again, an oxidized test bar of nickel aluminide IC 218 was prepared by oxidizing at 1000° C. in air for four hours. Resistance to attack from molten aluminum alloy 319 was determined by completely immersing test specimens into a crucible of molten aluminum alloy 319 maintained at 800° C. The composition of the aluminum melt was approximately 6.0 wt % Si, 3.5 wt % Cu, 1 wt % Fe, 1 wt % Zn, 0.5 wt % Mn, 0.25 wt % Ti, 0.1 wt % Mg, balance Al. The test specimens were removed and visually inspected and no degradation was apparent. These visual tests demonstrate that samples oxidized at 1000° C. for four hours survived six hours of continuous contact with molten aluminum alloy without substantial detrimental effect.

ANALYSIS OF REACTION PRODUCT OF OXIDIZED NICKEL ALUMINIDE AND MOLTEN ALUMINUM ALLOY 319

After immersion in a bath of molten aluminum alloy 319 for six hours, the oxidized nickel aluminide IC 218 showed two types of regions: (1) regions which were attacked and (2) regions which showed resistance to attack. Regions which showed no obvious attack were tested and found to consist of (1) an outer layer of $Al_2O_3$ containing 1 at% Ni and 0.7 at% Cr; (2) a middle layer of a metallic phase (93 at% Ni, 6 at% Cr, 1 at% Fe, 0.6 at% Al) which may have contained a small amount of oxygen (<10 at%); and (3) an inner layer of Al 03 containing 2 at% Ni and 4 at% Cr. The metallic phase might not have actually contained oxygen because the oxygen detected could have been detected from the oxide surrounding the thin metallic layer. Consequently, the compositions of the metallic layer and the inner $Al_2O_3$ layer may be identical to the oxidized material before immersion.

It is apparent from the regions that showed some attack that the molten aluminum had dissolved the outermost NiO layer which was originally present before the dipping. Therefore, the molten aluminum had dissolved the outermost NiO layer and some of the middle layer of $Ni(Al, Cr)_2O_4$ but did not react with the innermost layer of $Al_2O_3$. Thus, oxidized nickel aluminide should have a long service life when contacting molten aluminum. However, extensive dissolution and attack of the nickel aluminide had occurred at a corner of the piece which probably had not been oxidized uniformly. Here, attack proceeded underneath the non-continuous protective oxide.

EXAMPLE 3

Resistance to Attack by Molten Gray Iron

In Example 3, individual test bars were prepared by oxidizing under the following different conditions: 400° C. for 24 hours, 500° C. for 24 hours, 600° C. for 24 hours, 700° C. for 24 hours, 800° C. for 24 hours, 850° C. for 24 hours, 900° C. for 0.5 hour, 900° C. for 4 hours, 900° C. for 24 hours, 1000° C. for 0.5 hour, 1000° C. for 3 hours, 1000° C. for 4 hours, 1000° C. for 24 hours, 1100° C. for 0.5 hour, 1100° C. for 4 hours, and 1200° C. for 0.5 hour.

Resistance to attack by molten iron was determined for each test bar by repeatedly dipping the bars into molten gray iron maintained at 1450° C. The composition of the gray iron melt was approximately 3.35 wt % C, 2.0 wt % Si, 0.2 wt % Mn, 0.03 wt % S, 0.02 wt % P, balance Fe. The test bars were at room temperature prior to the first dip. Test specimens were dipped into the molten gray iron for five seconds, withdrawn and allowed to cool in still air for five seconds, and then dipped again. Bars were immersed ten times following this procedure.

The dip tests demonstrated that excellent resistance to attack from molten gray iron was achieved in samples which were oxidized at 850° C. for 24 hours, 900° C. for 4 and 24 hours, 1000° C. for 0.5, 3, 4 and 24 hours, and 1100° C. for 0.5 hours.

In contrast, a totally unoxidized sample and samples which were oxidized at 400° C., 500° C., 600° C., 700° C. and 800° C., all for 24 hours, at 900° C. for 0.5 hours, 1100° C. for 4 hours and 1200° C. for 0.5 hours exhibited poor resistance to attack from molten gray iron due to inadequate oxide layer thickness, improper oxide layer composition, or oxide spalling.

Samples which exhibited excellent resistance to attack showed only a small amount of dissolution or welding of gray iron on the bottom surface of the specimen. The bottom surface, the surface which rested on the furnace hearth during oxidation, may not have been oxidized as uniformly as the specimen sides.

EXAMPLE 4

Resistance to Attack by Molten Gray Iron

The specimens of Example 4 were prepared by oxidizing test bars at 700° C. for 4 hours, 850° C. for 24 hours, 1000° C. for 4 hours and 900° C. for 24 hours. The resistance to attack from molten gray iron was determined by immersing the oxidized bars into a crucible of molten gray iron maintained at 1400°-1450° C. The composition of the gray iron melt was approximately 3.35 wt % C, 2.0 wt % Si, 0.2 wt % Mn, 0.03 wt % S, 0.02 wt % P, balance Fe. The test bars, at room temperature prior to immersion, were immersed into the molten gray iron for at least 15 seconds. The samples oxidized at 700° C. suffered severe attack from molten gray iron and samples oxidized at greater than or equal to 850° C. (specifically, 850° C. for 24 hours, 1000° C. for 4 hours and 900° C. for 24 hours) suffered no significant attack from molten gray iron immersed for 15 seconds. Further, nickel-aluminide IC 218 oxidized at 1000° C. for four hours experienced no significant attack by the molten gray iron over a 30-second immersion.

ANALYSIS OF REACTION PRODUCT OF OXIDIZED NICKEL ALUMINIDE AND MOLTEN GRAY IRON

After immersion in molten gray iron for 30 seconds, a color change from dark green to black was observed in the samples oxidized at 850° C. for 24 hours, 1000° C. for 4 hours and 900° C. for 24 hours. The sample oxidized at 1000° C. for four hours was analyzed after exposure to the molten gray iron, and the reaction product layer formed by being exposed to molten gray iron was shown to consist of (1) an outer layer of $Fe_2O_3$ and (2) an inner layer which included $Ni(Al, Cr)_2O_4$ and $Al_2O_3$, the high Ni content metallic phase was found to be enriched in Fe (88 at% Ni, 8 at% Fe, 4 at% Cr).

From a comparison between the non-immersed sample and the immersed sample, it appears that molten gray iron did not attack the Ni(Al, Cr $_2O_4$ or the $Al_2O_3$ and only slowly attacked the high Ni content metallic phase. It also appears that the Fe in the inner layer was leached out by the melt.

EXAMPLE 5

Resistance to Attack by Molten Slag

The specimens of Example 5 were prepared by oxidizing test bars under the following conditions: (a) 850° C. for 24 hours, 900° C. for 4 hours, 1000° C. for 1 hour and 1100° C. for 0.5 hour. Resistance to attack from the molten slag which floats on top of molten gray iron was determined by repeatedly dipping test bars into a crucible of molten gray iron maintained at 1425° C. to 1475° C. The composition of the molten gray iron was the same as in the previous example Again, test specimens were at room temperature prior to dipping. The test specimens were dipped into the molten gray iron for five seconds, withdrawn and allowed to cool in still air for five seconds, and then dipped again for five seconds each. The test bars were immersed eight more times following this procedure. A visual test demonstrated that significant resistance to attack from molten gray iron slag was experienced in the oxidized samples.

ANALYSIS OF REACTION PRODUCT OF OXIDIZED NICKEL ALUMINIDE AND MOLTEN GRAY IRON SLAG

After 10 five second dips into molten gray iron, the color of the oxidized nickel aluminide alloy test bars changed from dark green to black. The specimen oxidized at 900° C. for four hours was analyzed after exposure to the gray iron slag, and the reaction product layer was shown to consist of a thick multi-phase layer of material including oxides containing Fe, Si, Al and Ni, the Ni being present in a small amount (0.5-1.5 at%), and a multi-elemental metallic phase which was analyzed and found to include 86 at% Ni, 13 at% Fe, 0.5 at% Al, 0.5 at% Cr. No Cr was detected in the oxide phases and no Si was detected in the metallic phase. All oxide phases contained about 20 at% Si but had widely ranging Fe and Al contents It appears that the slag on top of the molten gray iron dissolved some of the protective oxide layer and that the molten gray iron dissolved the high Ni content metallic phase of the two-phase middle layer described above as found in the oxide composition analysis before molten metal immersion. In light of these findings, the service life of oxidized nickel aluminide alloy would be expected to be primarily a function of the amount of slag available for attack.

While our invention has been described in terms of specific embodiments, it will be appreciated that other embodiments could readily be adapted by one skilled in the art. Accordingly, the scope of our invention is to be limited only by the following claims.

The embodiments of the invention in which an exclusive property or privilege is claimed are defiend as follows:

1. A foundry melt containment apparatus comprising a protectively-coated metal wall for containing molten metal and formed of a predominantly nickel alloy containing aluminum and chromium in amounts effective to produce a predominantly L12 ordered face-centered cubic phase material, said wall having a melt-contact surface covered by a protective integral oxide coating including a first layer formed mainly of alumina immediately overlying the metal wall and a second layer overlying the first layer and predominantly composed of a spinel having a metal constituent taken from the group consisting of nickel, aluminum and chromium.

2. A foundry melt containment apparatus comprising a protectively-coated metal wall for containing molten aluminum-base or iron-base metal, said wall being formed of a nickel-based alloy comprising between about 8 and 10 weight percent aluminum and between about 1.5 and 8 weight percent chromium, said wall bearing a melt-contact surface including a protective integral oxide coating comprising a first layer formed mainly of alumina immediately adjacent the alloy and a second layer overlying said first layer, said first layer being between 0.5 and 3 microns thick and containing at least 95 weight percent alumina, said second layer being at least 10 microns thick and predominantly composed of an oxide characterized by a spinel lattice structure having a metal constituent selected from the group consisting of nickel, aluminum and chromium.

* * * * *